US007543567B2

(12) United States Patent
Gibson et al.

(10) Patent No.: US 7,543,567 B2
(45) Date of Patent: Jun. 9, 2009

(54) FUEL SYSTEM HAVING A ONE-PIECE HOLLOW TUBE CONNECTION

(75) Inventors: Dennis H. Gibson, Chillicothe, IL (US); Alan R. Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/976,797

(22) Filed: Oct. 29, 2007

(65) Prior Publication Data

US 2009/0107462 A1 Apr. 30, 2009

(51) Int. Cl.
*F02M 69/46* (2006.01)
*F02M 69/50* (2006.01)

(52) U.S. Cl. ..... 123/456; 123/470

(58) Field of Classification Search ..... 123/456, 123/468, 469, 470, 472; 285/288.1, 189, 285/197, 332.2, 382, 382.4, 382.5
See application file for complete search history.

(56) References Cited

U.S. PATENT DOCUMENTS 3,402,703 A 9/1968 Dickerson et al.
3,845,748 A 11/1974 Eisenberg
4,485,790 A 12/1984 Nishimura et al.
5,172,939 A 12/1992 Hashimoto
5,261,705 A 11/1993 Takahashi et al.
5,365,907 A 11/1994 Dietrich et al.
5,617,828 A 4/1997 Kuegel et al.
5,775,303 A 7/1998 Sweetland et al.
6,102,007 A * 8/2000 Furst ..... 123/469
6,148,797 A * 11/2000 Gmelin ..... 123/456
6,234,413 B1 * 5/2001 Greaney ..... 239/533.2
6,279,540 B1 * 8/2001 Greaney et al. ..... 123/470
6,415,768 B1 7/2002 Usui
6,418,911 B1 * 7/2002 Augustin ..... 123/468
6,565,128 B2 5/2003 Augustin
6,736,431 B2 5/2004 Jung et al.
2006/0243254 A1 * 11/2006 Yahara ..... 123/470
2008/0098989 A1 5/2008 Harmon

* cited by examiner

*Primary Examiner*—Mahmoud Gimie
(74) *Attorney, Agent, or Firm*—Finnegan, Henderson, Farabow, Garrett & Dunner

(57) ABSTRACT

A fuel system for an engine including a cylinder head having a first bore and a second bore intersecting the first bore is disclosed. The fuel system includes a common rail and a fuel injector coupled to the cylinder head and at least partially received within the first bore. The fuel system also includes a one-piece hollow tube, extending linearly from the common rail to the fuel injector through the second bore. The one-piece hollow tube is configured to communicate high pressure fuel from the common rail to the fuel injector.

11 Claims, 2 Drawing Sheets

FUEL SYSTEM HAVING A ONE-PIECE HOLLOW TUBE CONNECTION

TECHNICAL FIELD

The present disclosure is directed to a fuel system and, more particularly, to a fuel system having a one-piece hollow tube connection.

BACKGROUND

Fuel systems typically employ multiple fuel injectors to inject high pressure fuel into combustion chambers of an engine. This high pressure fuel is supplied to the fuel injectors via a common rail secured to the engine and individual fuel lines connected between the common rail and the fuel injectors. Because of the geometry of the engine and/or other components associated with the engine, the fuel lines typically include bends, and must be fabricated from a thin-walled material that can withstand bending experienced during fabrication without rupture. Although suitable for many applications, such a fuel system configuration may not be suitable for higher pressure applications. Specifically, the strength of the material used to connect the common rail and the fuel injector is a limiting factor in the maximum operating pressure of those fuel systems.

In some configurations, a high strength component is used to form a portion of the conduit between the common rail and the fuel injector, with the remaining portion of the fuel conduit being made up of conventional fuel lines. Such a fuel system is described in U.S. Pat. No. 5,775,303 (the '303 patent) issued to Sweetland et al. on Jul. 7, 1998. The '303 patent describes a high pressure fuel line connection assembly including a fuel line, a fuel injector, and an elongated fuel line adapter conducting fuel from the fuel line to the fuel injector. The fuel line adapter is inserted in an angled bore within the cylinder head and received on one end by a detent formed in an outer portion of the injection nozzle in a region of the injection nozzle for receiving high pressure fuel for injection. A tube nut, positioned about the fuel line, is threadingly engaged with the cylinder head such that the fuel line assembly is in a secured position and such that a compressive force couples the leading end of the fuel line with the second end of the fuel line adapter.

Although the fuel system of the '303 patent may provide a high strength component for a portion of the conduit from the fuel rail to the fuel injector, the operating pressure of fuel systems containing such an arrangement may still be limited by the strength of the fuel line component found in the remainder of the fuel conduit. Furthermore, the configuration described in the '303 patent requires a single connection between the fuel line and the fuel line adapter. Specifically, the single connection between the fuel line and the fuel line adapter may provide a site for leakage to occur.

SUMMARY

One aspect of the present disclosure is directed towards a fuel system for an engine including a cylinder head having a first bore and second bore intersecting the first bore. The fuel system may include a common rail and a fuel injector coupled to the cylinder head and at least partially received within the first bore. The fuel system may also include a one-piece hollow tube, extending linearly from the common rail to the fuel injector through the second bore. The one-piece hollow tube is configured to communicate high pressure fuel from the common rail to the fuel injector.

Another aspect of the present disclosure is directed toward a method of assembling a fuel system for an engine. The method includes positioning a first end of a one-piece hollow tube inside a second bore within a cylinder head. The method also includes coupling the first end of the hollow tube to a fuel injector coupled to the cylinder head. The method also includes coupling a second end of the hollow tube to a port on a common rail.

DETAILED DESCRIPTION

Figure 1:
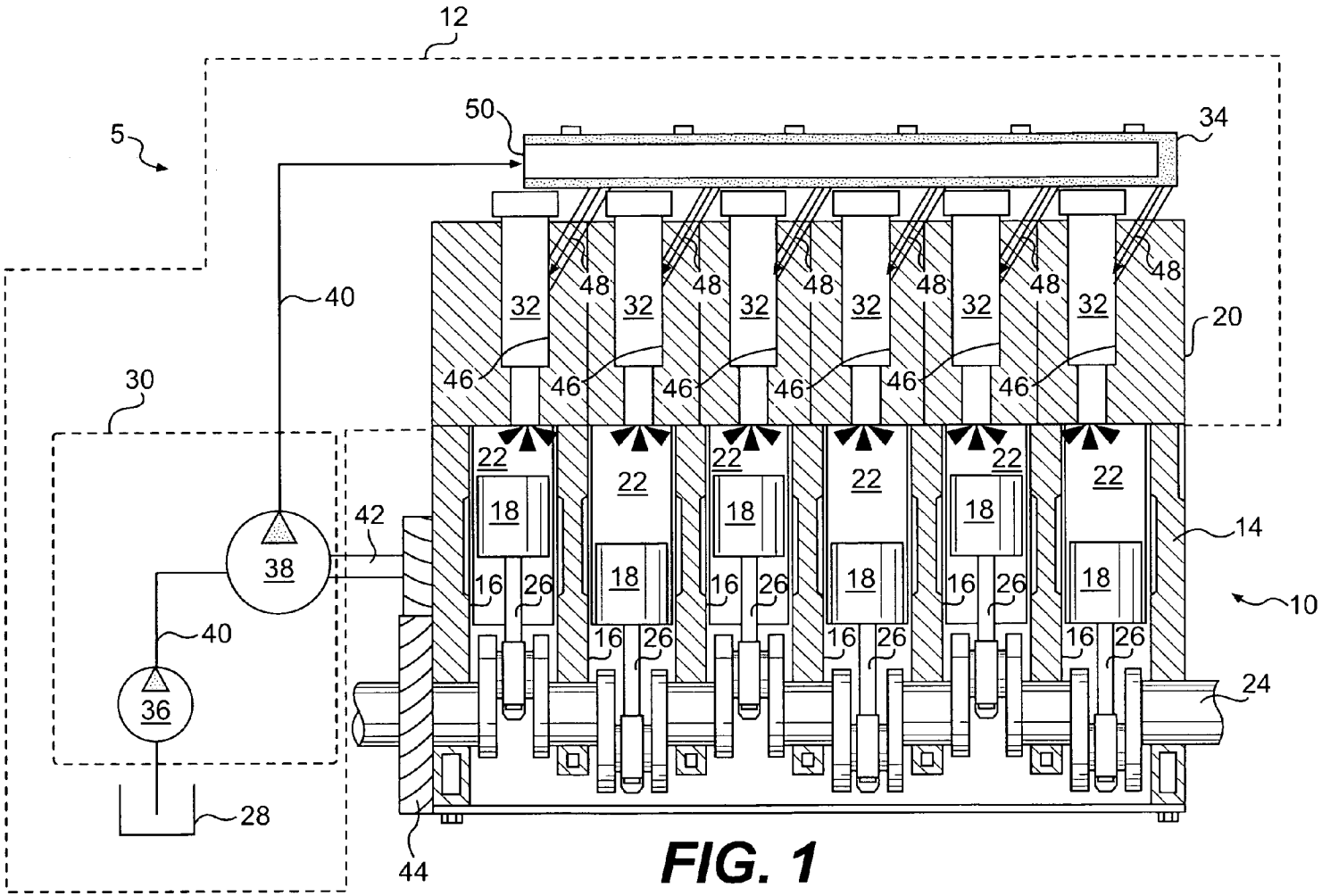
FIG. 1 is a schematic and diagrammatic illustration of an exemplary disclosed power system.

FIG. 1 illustrates a power system 5 having an internal combustion engine 10 connected to an exemplary embodiment of a fuel system 12. One skilled in the art would recognize that engine 10 may be any type of internal combustion engine such as, for example, a diesel engine, a gasoline engine, a gaseous fuel powered engine, a heavy fuel engine, or any other type of engine apparent to one skilled in the art.

Engine 10 may include an engine block 14 that defines a plurality of cylinders 16, a piston 18 slidably disposed within each cylinder 16, and a cylinder head 20 associated with each cylinder 16. Cylinder 16, piston 18, and cylinder head 20 may form a combustion chamber 22. In the illustrated embodiment, engine 10 includes six combustion chambers 22. However, engine 10 may include a greater or lesser number of combustion chambers 22. Furthermore, combustion chambers 22 may be disposed in an "in-line" configuration, a "V" configuration, or any other suitable configuration. In some engine configurations, there may be separate banks of combustion chambers 22, and associated pistons 18 and cylinders 16. For example, in a "V" configuration, there may be two banks of combustion chambers 22 and there may be a cylinder head 20 associated with each bank.

As shown in FIG. 1, engine 10 may include a crankshaft 24 that is rotatably supported within engine block 14 by way of a plurality of journal bearings (not shown). A connecting rod 26 may connect each piston 18 to crankshaft 24 so that a sliding motion of piston 18 within each cylinder 16 results in a rotation of crankshaft 24. In a similar respect, rotary motion of crankshaft 24 may result in sliding motion of piston 18.

Fuel system 12 may include components that deliver injections of pressurized fuel into each combustion chamber 22 of engine 10. Specifically, fuel system 12 may include a tank 28 configured to hold a supply of fuel, and a fuel pumping arrangement 30 configured to pressurize fuel and direct the pressurized fuel to a plurality of fuel injectors 32 via a common rail or manifold 34.

Fuel pumping arrangement 30 may include one or more pumping devices that function to increase the pressure of the fuel and direct one or more pressurized streams of fuel to the common rail 34. In one example, fuel pumping arrangement 30 may include a low pressure source 36 and a high pressure source 38 disposed in series and connected by way of a fuel line 40. Low pressure source 36 may embody a transfer pump configured to provide low pressure feed to high pressure source 38. High pressure source 38 may be configured to receive the low pressure feed and to increase the pressure of the fuel.

One or both of low and high pressure sources 36, 38 may be operably connected to engine 10 and driven by crankshaft 24.

Low and/or high pressure sources 36, 38 may be connected with crankshaft 24 in any manner readily apparent to one skilled in the art where a rotation of crankshaft 24 will result in a corresponding rotation of a pump driveshaft 42. For example, a pump driveshaft 42 of high pressure source 38 is shown in FIG. 1 as being connected to crankshaft 24 through a gear train 44. It is contemplated however, that one or both of low and high pressure sources 36, 38 may alternatively be driven electrically, hydraulically, pneumatically, or in any other appropriate manner.

Fuel injectors 32 may be disposed in a first bore 46 within cylinder heads 20 and connected to common rail 34 by way of a plurality of one-piece hollow tubes 48. Each fuel injector 32 may be operable to inject an amount of pressurized fuel into an associated combustion chamber 22 at predetermined times, fuel pressures, and fuel flow rates. Fuel injectors 32 may be hydraulically, mechanically, electrically, or pneumatically operated.

Common rail 34 may be configured to distribute fuel to fuel injectors 32 and may include an inlet 50 in communication with fuel line 40. It is contemplated that multiple common rails 34 may be included in power system 5, each common rail 34 distributing fuel to fuel injectors 32 associated with separate banks of combustion chambers 22.

Figure 2:
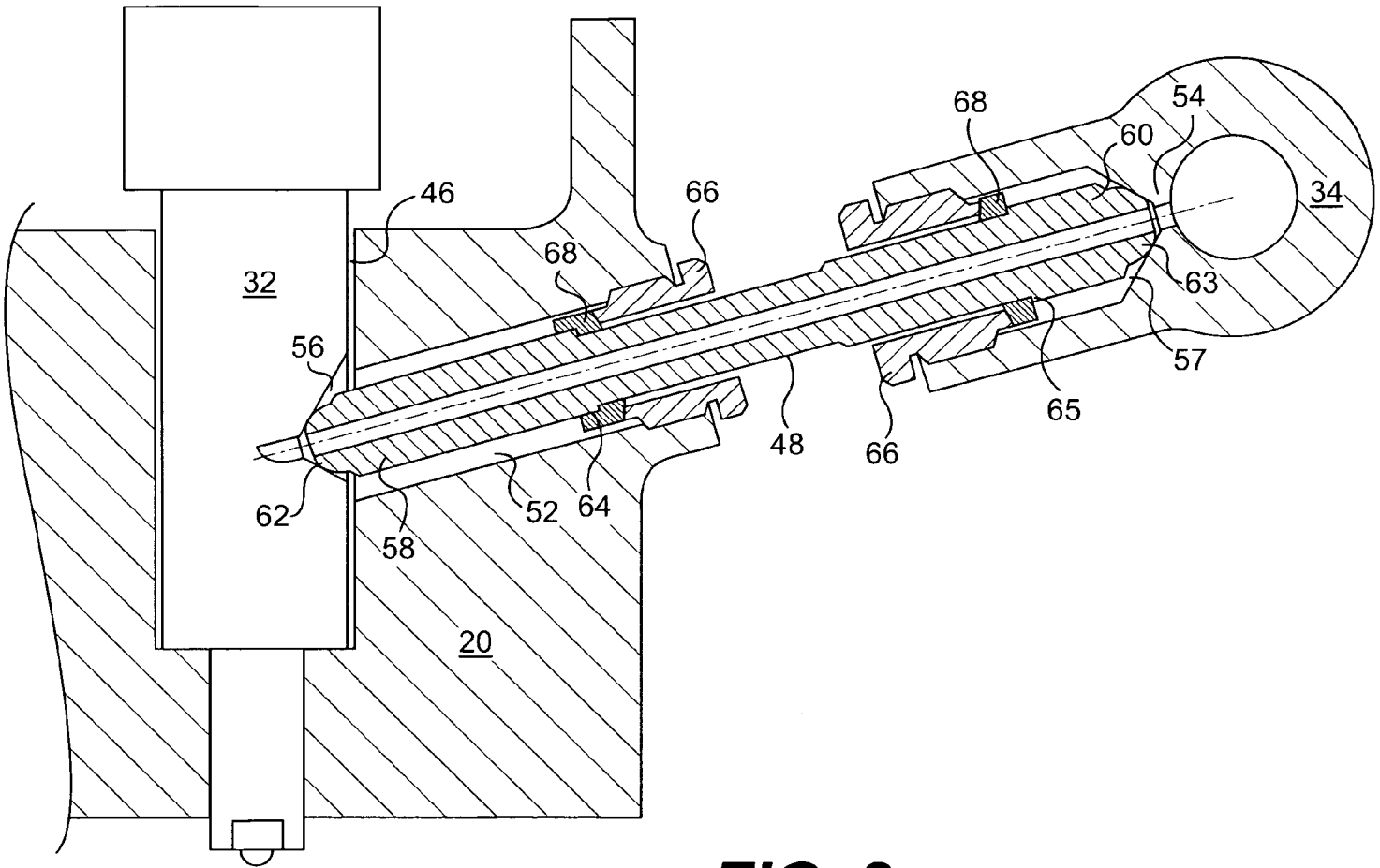
FIG. 2 is a cross-sectional illustration of a portion of an exemplary disclosed fuel system for a power system.

Referring to FIG. 2, an exemplary embodiment of one fuel injector 32 associated with a common manifold 34 is illustrated. Fuel system 12 may include a one-piece hollow tube 48 extending linearly from common rail 34 to fuel injector 32. Hollow tube 48 may pass through a second bore 52 in cylinder head 20. Hollow tube 48 may be configured to communicate fuel from common rail 34 to fuel injector 32. It is contemplated that hollow tube 48 may be heat treated. It is further contemplated that hollow tube 48 may be constructed from wall material that is thick relative to the inner diameter of hollow tube 48. For example, the wall material of hollow tube 48 may be thicker than the inner diameter of hollow tube 48 as illustrated in FIG. 2. In addition, hollow tube 48 may be constructed from material with strength sufficient to be capable of withstanding pressures up to 300 MPa. For example, the material of hollow tube 48 may be, but is not limited to, medium or high carbon steel. Hollow tube 48 may include various cross-sectional shapes. For example, hollow tube 48 may include a cross-section that is circular, oval, rectangular, or any other shape.

Common rail 34 and fuel injector 32 may be configured to receive a plurality of hollow tubes 48. For example, fuel injector 32 may include a first female conical seating surface 56. Common rail 34 may include a plurality of ports 54 having a second female conical seating surface 57. Hollow tube 48 may include a first end 58 and a second end 60 having respectively first and second male spherical sealing surface 62, 63. During assembly, male spherical sealing surfaces 62, 63 of hollow tube 48 engages shallow angled female conical seating surfaces 56, 57 of port 54 and fuel injector 32. During engagement, one or both of the surfaces may deform and/or deflect slightly, and a sealing interface may be created therebetween that is maintained even during relative rotational or translational movement. It is contemplated that common rail 34 and fuel injector 32 may alternatively include male spherical sealing surfaces and hollow tube 48 may include female conical seating surfaces.

Hollow tube 48 may include first flange 64 and second flange 65 adjacent to first and second ends 58, 60, respectively, of hollow tube 48. Flanges 64, 65 are configured to engage with first load nut 66 and second load nut 67, respectively, to couple first end 58 of hollow tube 48 to cylinder head 20 and to secure second end 60 to common rail 34. A split spherical washer 68 may be placed between each flange 64, 65 and load nut 66, 67. By securing hollow tube 48 to cylinder head 20, hollow tube 48 is urged against fuel injector 32 such that the male spherical sealing surface 62 sealingly engages the female conical seating surface 56 of fuel injector 32, minimizing the chance of fuel leakage into engine cylinder 16.

It is noted that the diameter of hollow tube 48 may be slightly less than the second bore 52 in cylinder head 20. This permits ease of insertion of the hollow tube 48 into second bore 52 and into contact with fuel injector 32, while also providing a leakage flow path about the hollow tube 48. Any leakage about hollow tube 48 may pass through second bore 52 towards the fuel injector 32 and may drain to the fuel supply in a manner known to one skilled in the art.

INDUSTRIAL APPLICABILITY

The fuel system of the present disclosure has wide applications in a variety of engine types including, for example, diesel engines, gasoline engines, gaseous fuel-powered engines, and heavy fuel engines. The disclosed fuel system may be implemented in any engine that utilizes a common manifold for distributing pressurized fluid and where high operating pressures occur. Assembly of the fuel system will now be described.

During assembly, fuel injector 32 may be placed into a first bore 46 in the cylinder head 20, and a one-piece hollow tube 48 may be placed through a second bore 52 in the cylinder head 20, such that hollow tube 48 is in contact with fuel injector 32. First male spherical sealing surface 62 may engage first female conical seating surface 56. Second male spherical sealing surface 63, may engage second female conical seating surface 57 as common rail 34 is moved into position. To retain hollow tube 48 in position relative to fuel injector 32 and common rail 34, flange 64, 65 adjacent to ends 58, 60 of hollow tube 48 may engage with load nuts 66, 67 so that hollow tube 48 is coupled to cylinder head 20 and to common rail 34. First male spherical sealing surface 62 may be configured to sealingly engage first female conical seating surface 56 when the hollow tube 48 is secured to cylinder head 20. After assembly of fuel system 12 to engine 10, a linear conduit may be provided to communicate high pressure fuel from common rail 34 to fuel injector 32.

Fuel system 12 may provide a high strength conduit that supports operating pressures for high pressure applications. In particular, because one-piece hollow tube 48 extends linearly from common rail 34 to fuel injector 32, it may be fabricated from thick-wall, heat-treated, high strength material allowing for pressurized fuel to safely pass through hollow tube 48. Hollow tube 48 may be able to withstand fuel pressures as high as 300 MPa.

It will be apparent to those skilled in the art that various modifications and variations can be made to the disclosed fuel system without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A fuel system for an engine including a cylinder head having a first bore and a second bore intersecting the first bore, the fuel system comprising:

a common rail;

a fuel injector coupled to the cylinder head and at least partially received within the first bore; and a one-piece hollow tube, extending linearly from the common rail to the fuel injector through the second bore, wherein the hollow tube includes a first end having a first male spherical surface and a second end having a second male spherical sealing surface, the first male spherical surface configured to be axially compressed against a first female conical seating surface of the fuel injector and the second male spherical sealing surface configured to be axially compressed against a second female conical seating surface of the common rail, to communicate pressurized fuel from the common rail to the fuel injector.

2. The fuel system claim 1, wherein the first female conical seating surface and the second female conical seating surface are each configured to deform upon engagement with the first male spherical sealing surface and the second male spherical sealing surface, respectively, to form sealing interfaces.

3. The fuel system of claim 1, wherein the hollow tube includes a first flange adjacent to the first end and a second flange adjacent the second end.

4. The fuel system of claim 3, wherein the first flange and the second flange are each configured to engage a load nut to couple the first end of the hollow tube to the cylinder head and to couple the second end of the hollow tube to the common rail.

5. The fuel system of claim 1, wherein the hollow tube is constructed from wall material that is thick relative to the inner diameter of the hollow tube.

6. The fuel system of claim 1, wherein the hollow tube is constructed from material with strength sufficient to withstand pressures up to 300 MPa.

7. The fuel system and cylinder head of claim 1, wherein the hollow tube is heat-treated.

8. A method of assembling a fuel system for an engine, comprising:

positioning a first end of a one-piece hollow tube inside a bore within a cylinder head;

coupling a first end of the hollow tube to a fuel injector coupled to the cylinder head; and coupling a second end of the hollow tube to a port on a common rail, wherein coupling the first end of the hollow tube to the fuel injector and coupling the second end of the hollow tube to the common rail each includes axially compressing a male spherical sealing surface on the hollow tube against a female conical seating surface to deform the female conical seating surface and provide a substantially fluid tight seal.

9. The method of claim 8, including coupling the hollow tube to the cylinder head by engaging a first load nut with a first flange on the hollow tube and with the cylinder head, and coupling the hollow tube to the common rail by engaging a second load nut with a second flange on the hollow tube and with the common rail.

10. A power system comprising:

an engine block having a plurality of combustion chambers;

a cylinder head having a plurality of first bores and a plurality of second bores intersecting the plurality of first bores; and a fuel system configured to supply pressurized fuel to the plurality of combustion chambers, wherein the fuel system includes:

a common rail with a plurality of ports;

a fuel injector coupled within each of the plurality of first bores; and a plurality of one-piece hollow tubes, each one-piece hollow tube extending linearly between one of the plurality of ports of the common rail and one of the fuel injectors, wherein the plurality of one-piece hollow tubes are configured to communicate fuel from the plurality of ports of the common rail to the fuel injectors, wherein each of the plurality of one-piece hollow tubes is coupled to the cylinder head by a first load nut and is coupled to the common rail by a second load nut, the first load nut applying a load force to axially compress a first end of the one-piece hollow tube including a first male spherical surface against a first female conical surface of the fuel injector and the second load nut applying a load force to axially compress a second end of the one-piece hollow tube including a second male spherical surface against a second female conical surface of the common rail.

11. The power system of claim 10, wherein each of the plurality of one-piece hollow tubes includes a first flange and a second flange and wherein the first load nut engages the first flange and the second load nut engages the second flange.

* * * * *